US007278634B2

(12) United States Patent
Wingate et al.

(10) Patent No.: US 7,278,634 B2
(45) Date of Patent: Oct. 9, 2007

(54) DEVICE FOR CONTROLLING PRINTED PRODUCTS

(75) Inventors: Mark Anthony Wingate, Rochester, NH (US); Matthew Jon Wingate, Durham, NH (US)

(73) Assignee: Goss International Americas, Inc., Dover, NH (US)

( * ) Notice: Subject to any disclaimer, the term of this patent is extended or adjusted under 35 U.S.C. 154(b) by 826 days.

(21) Appl. No.: 10/631,888

(22) Filed: Jul. 31, 2003

(65) Prior Publication Data

US 2007/0052159 A1 Mar. 8, 2007

(51) Int. Cl.
*B65H 5/22* (2006.01)

(52) U.S. Cl. ..... 271/6; 271/4.06; 271/4.09; 271/7; 271/10.06; 271/10.07; 271/10.01; 271/10.15; 271/34; 271/198

(58) Field of Classification Search ..... 271/198, 271/6, 4.06, 4.05, 4.09, 4.11, 7, 12, 10.06, 271/10.07, 10.01, 10.15, 34, 35; 198/835
See application file for complete search history.

(56) References Cited

U.S. PATENT DOCUMENTS

| | | | | |
|---|---|---|---|---|
| 2,439,520 | A * | 4/1948 | Miller | 74/421 R |
| 5,392,700 | A | 2/1995 | Kleinhen | 100/7 |
| 5,451,040 | A | 9/1995 | Crabtree | 271/10.11 |
| 5,538,242 | A | 7/1996 | Doucet | 271/299 |
| 5,688,219 | A | 11/1997 | Renard et al. | 493/357 |
| 6,109,427 | A * | 8/2000 | Hosch et al. | 198/835 |
| 6,267,366 | B1 | 7/2001 | Graushar et al. | 270/1.02 |
| 6,302,392 | B1 | 10/2001 | Schaefer et al. | 271/283 |
| 6,394,445 | B1 | 5/2002 | D'Agrella et al. | 271/182 |
| 6,464,218 | B2 | 10/2002 | Neary et al. | 271/270 |
| 2002/0066648 | A1 * | 6/2002 | Dreyer | 198/835 |
| 2003/0045417 | A1 | 3/2003 | Wingate et al. | 493/320 |

* cited by examiner

*Primary Examiner*—David H Bollinger
(74) *Attorney, Agent, or Firm*—Davidson, Davidson & Kappel, LLC

(57) ABSTRACT

A tape transport system for printed products includes a tape having a tape width, a pulley, and a lever arm supporting the pulley, the lever arm having a first side and a second side. The pulley has a first section disposed on the first side of the lever arm and a second section disposed on the second side of the lever arm, the first and second sections supporting the tape so that the lever arm is within the tape width.

13 Claims, 5 Drawing Sheets

DEVICE FOR CONTROLLING PRINTED PRODUCTS

BACKGROUND INFORMATION

The present invention relates generally to controlling printed products, for example signatures.

In a folder of a printing press, a web of paper often is folded and then cut, for example using a first set of cutting cylinders to make a first cut, and then a second set of cutting cylinders further downstream to complete the cut to form signatures. Tapes often are used to support the signatures on both sides while the second set of cutting cylinders is finishing the cut between the tapes. A delivery device, for example deceleration drum, then can grip the front edge of the signatures through the tapes so as to transfer the signatures to the deceleration drum. A set of grippers that extends through the tapes is typically provided in the delivery device.

U.S. Patent Publication No. 2003/0045417, hereby incorporated by reference herein, discloses a tape transport system for printed products with tapes, pulleys supporting the tapes, and lever arms supporting the pulleys. Each lever arm includes a first side rail and a second side rail, with the pulley supported rotatably between the first and second side rails.

BRIEF SUMMARY OF THE INVENTION

An object of the present invention is to provide a lever arm directly underneath the tape.

A further alternate or additional object of the invention is to be able to provide a stiff lever arm.

Yet another alternate or additional object of the present invention is to provide for easy maintenance and/or longer bearing life.

The present invention provides a tape transport system for printed products comprising a tape having a tape width, a pulley, and a lever arm supporting the pulley, the lever arm having a first side and a second side, the pulley having a first section disposed on the first side of the lever arm and a second section disposed on the second side of the lever arm, the first and second sections supporting the tape so that the lever arm is within the tape width.

By having the two-sectioned pulley, the lever arm can support the tape directly underneath tape, and be made thicker to provide more strength. No components to the side of the pulley, which can interfere with transfer grippers or other moving components, are needed. Maintenance is easier, as the pulley is easily assembled and disassembled.

Preferably a plurality of tapes are provided, each tape supported by a two-sectioned pulley and lever arm.

The present invention also provides a method for transporting printed products comprising transporting signatures using a tape, and passing the tape over a pulley on a lever arm, the lever arm having a first side and a second side, the pulley having a first section disposed on the first side of the lever arm and a second section disposed on the second side of the lever arm, the first and second sections supporting the tape so that the lever arm is within the tape width.

The present invention also provide a folder comprising:

a tape transport system for printed products including a first tape having a first tape width, a first pulley, and a first lever arm supporting the first pulley, the first lever arm having a first lever arm first side and a first lever arm second side, the first pulley having a first pulley first section disposed on the first lever arm first side and a first pulley second section disposed on the first lever arm second side, the first pulley first section and first pulley second section supporting the first tape so that the first lever arm is within the first tape width; and including a second tape having a second tape width, a second pulley, and a second lever arm supporting the second pulley, the second lever arm having a second lever arm first side and a second lever arm second side, the second pulley having a second pulley first section disposed on the second lever arm first side and a second pulley second section disposed on the second lever arm second side, the second pulley first section and second pulley second section supporting the second tape so that the second lever arm is within the second tape width; and a printed product transfer device including at least one component passable between the first tape and the second tape.

Preferably, the transfer device is a deceleration drum and the component a gripper.

BRIEF DESCRIPTION OF THE DRAWINGS

An exemplary embodiment of the present invention is described below by reference to the following drawings, in which.

DETAILED DESCRIPTION

Figure 1:
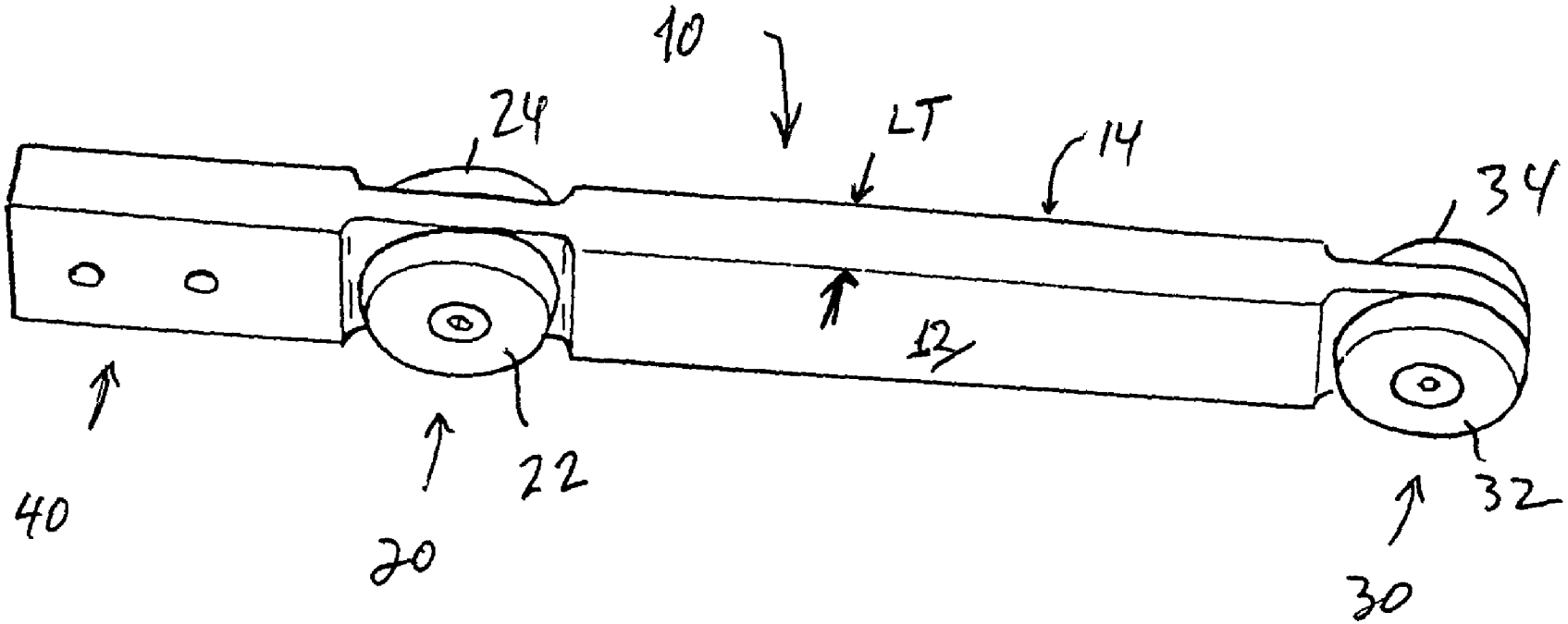
FIG. 1 shows a simplified view of a lever arm and pulley according to the present invention.

FIG. 1 shows partially a lever arm 10 of the present invention having a lever arm first side 12 and an opposing second side, indicated by arrow 14. Lever arm 10 supports two pulleys 20, 30. Pulley 20 has a first section 22 on side 12, and a second section 24 on side 14, and pulley 30 has a first section 32 on side 12 and a second section 34 on side 14. A plurality of lever arms 10 may be attached via an end 40 to a support block, as described in incorporated-by-reference U.S. Patent Publication No. 2003/0045417, for movement and rotation thereabout. Lever arm 10 may have a thickness LT.

Figure 2:
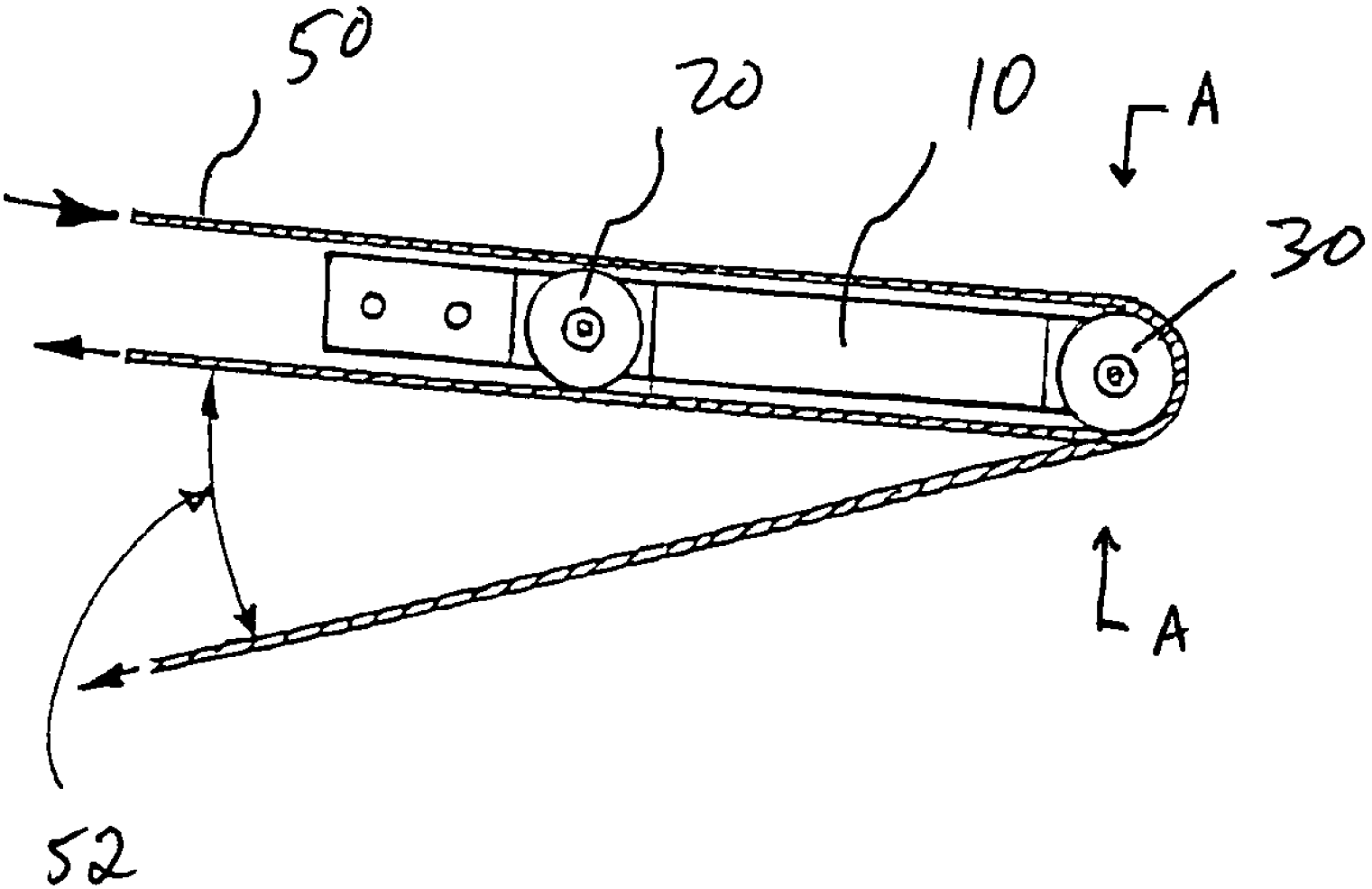
FIG. 2 shows the lever arm, pulley and tape according to the present invention.

As shown in FIG. 2, a tape 50 can run over pulleys 20, 30 without contacting lever arm 10, and may exit over a range 52 of angles after leaving end pulley 30, including a 180 degree turn.

Figure 3:
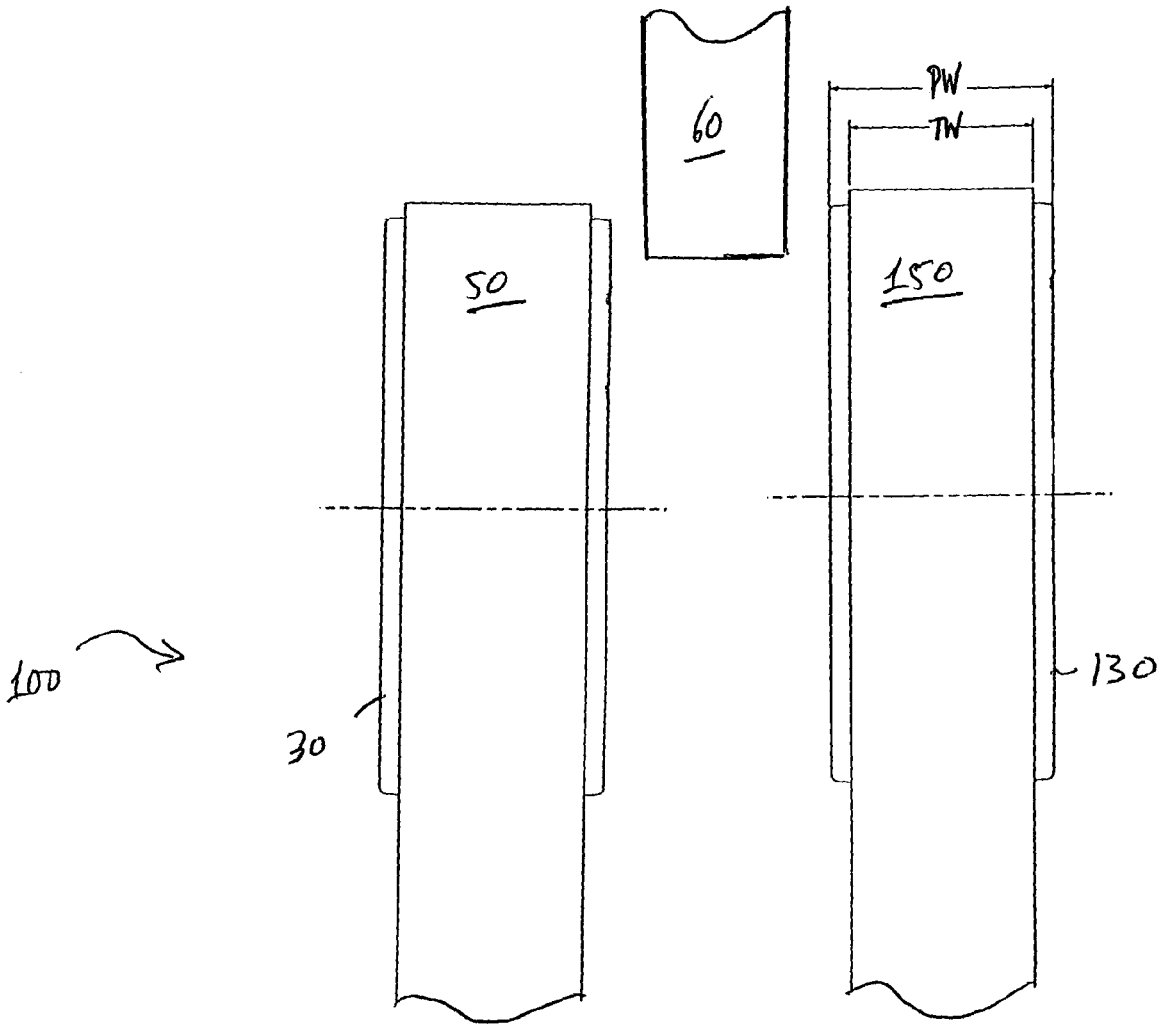
FIG. 3 shows a partial view of the transport system of the present invention.

FIG. 3 shows a partial view of tape transport system 100, with two tapes 50, 150. Tape 50 runs over pulley 30, and tape 150 over a two-sectioned end pulley 130 of a second lever arm similar to lever arm 10. A gripper 60 or other component of a printed product transfer device passes between the first tape 50 and the second tape 150. Pulleys 30, 130 may be of a width PW and tapes 50,150 of a width TW. PW may be for example 19.4 mm and TW 16 mm, and the ratio PW:TW is preferably 1.5:1 or less, but preferably at least 1.05 to 1. Advantageously, the lever arm 10 thickness LT (FIG. 1) is less than PW and thus also TW, so that the lever arm 10 is fully within tape width TW.

Figure 4:
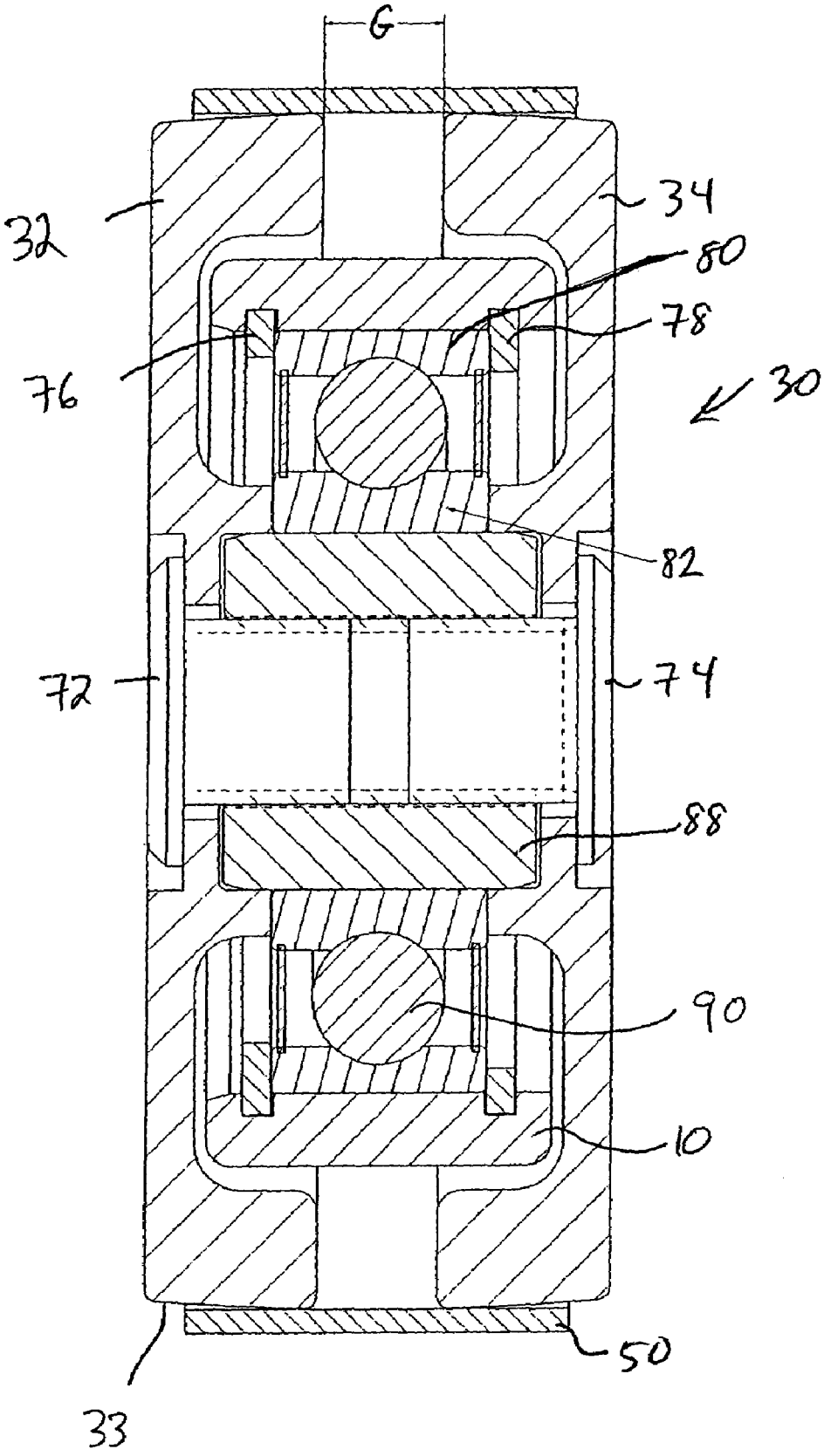
FIGS. 4 and 5 show details of the two-sectioned pulley of the present invention.
Figure 5:
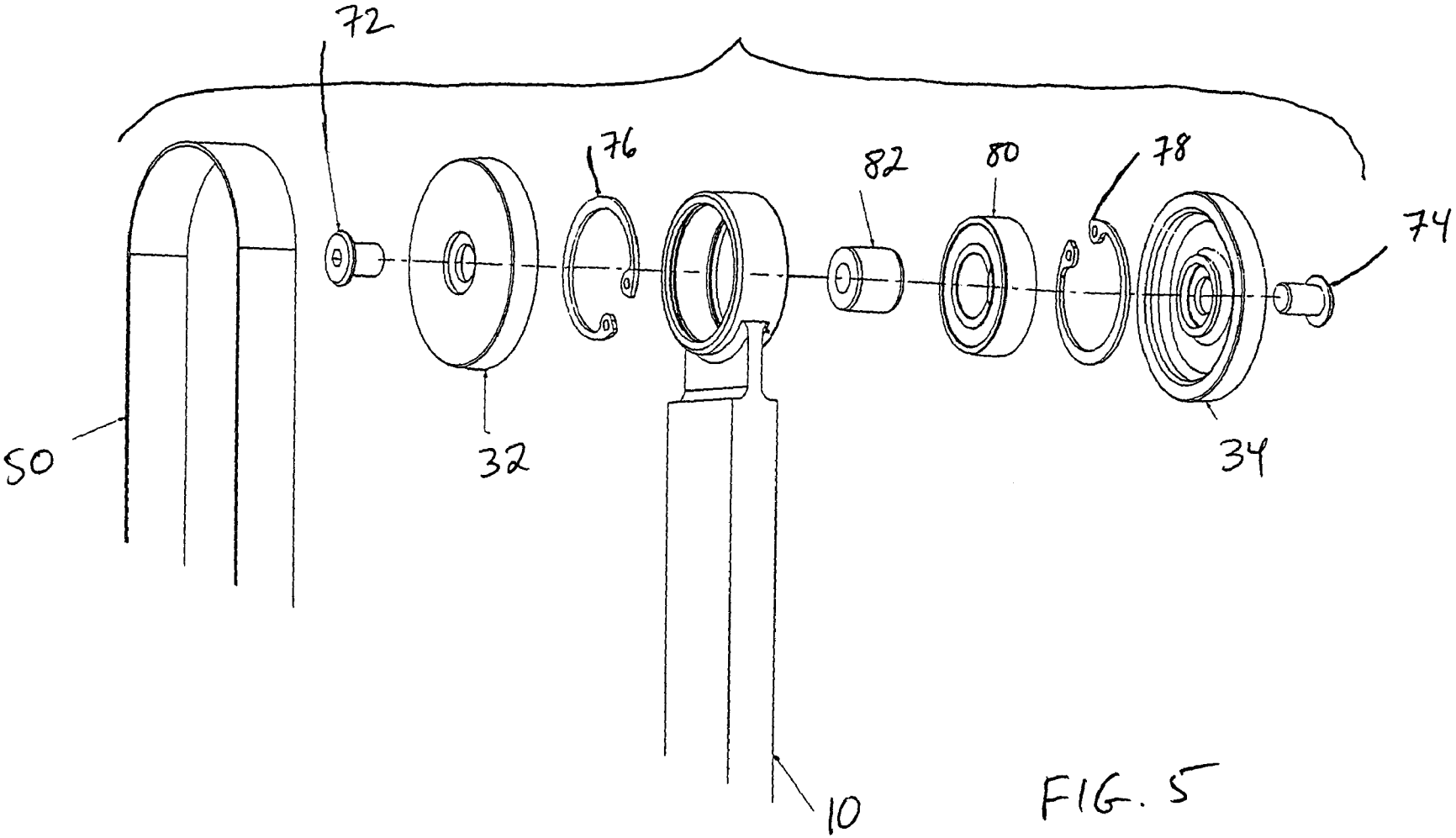

FIG. 4 shows a sectional view through A-A of FIG. 2, and shows more details of the pulley 30 supporting tape 50 at the end of lever arm 10. FIG. 5 shows an exploded perspective view of FIG. 4. Pulley 30 has first section 32 and second section 34, which are separated at tape 50 by a gap G, which may be for example 5 mm wide. The outer surface of 33 of the sections 32, 34 may be crowned.

Sections 32, 34 are held together by two head cap screws 72, 74 which screw together to fix sections 32, 34 to a rotatable inner race 82 of a bearing 90. A shaft 88 can support the interior surface of the bearing 90 as well. An outer race 80 of bearing is fixed to the lever arm 10 via retaining rings 76, 78.

Bearings with a rotating inner race often have better performance characteristics. Other advantages of the present invention include that: the tapes can wrap the split pulley and lever arm assemblies by 180 degrees (as shown in FIG. 2); the split pulleys are easily assembled and disassembled; and that standard crowns and guide flanges can be used with the split pulleys.

What is claimed is:

1. A tape transport system for printed products comprising:

a tape having a tape width, a pulley, the tape running over the pulley in a travel direction, the tape width being perpendicular to the travel direction, and a lever arm supporting the pulley, the lever arm having a first side and a second side, the pulley having a first section disposed on the first side of the lever arm and a second section disposed on the second side of the lever arm, the first and second sections supporting the tape so that the lever arm is within the tape width.

2. The tape transport system as recited in claim 1 further comprising a second tape, a second pulley, and a second lever arm supporting the second pulley, the second pulley having a second pulley first section on one side of the second lever arm and a second pulley second section on another side of the second lever arm.

3. The tape transport system as recited in claim 1 wherein the pulley includes a bearing with a rotatable inner race.

4. The tape transport system as recited in claim 1 further comprising a second pulley on the lever arm, the second pulley having a second pulley first section on the first side and a second pulley second section on the second side.

5. The tape transport system as recited in claim 4 wherein the tape contacts the pulley and the second pulley in a 180 degree fashion.

6. A method for transporting printed products comprising:

rotating a tape for transporting the printed products, and passing the tape over a pulley on a lever arm in a travel direction, the lever arm having a first side and a second side, the pulley having a first section disposed on the first side of the lever arm and a second section disposed on the second side of the lever arm, the first and second sections supporting the tape so that the lever arm is within a width of the tape, the width being perpendicular to the travel direction.

7. A folder comprising:

a tape transport system for printed products including a first tape having a first tape width, a first pulley, and a first lever arm supporting the first pulley, the first lever arm having a first lever arm first side and a first lever arm second side, the first pulley having a first pulley first section disposed on the first lever arm first side and a first pulley second section disposed on the first lever arm second side, the first pulley first section and first pulley second section supporting the first tape so that the first lever arm is within the first tape width; and including a second tape having a second tape width, a second pulley, and a second lever arm supporting the second pulley, the second lever arm having a second lever arm first side and a second lever arm second side, the second pulley having a second pulley first section disposed on the second lever arm first side and a second pulley second section disposed on the second lever arm second side, the second pulley first section and second pulley second section supporting the second tape so that the second lever arm is within the second tape width; and a printed product transfer device including at least one component passable between the first tape and the second tape.

8. The folder as recited in claim 7 wherein the component is a gripper.

9. The folder as recited in claim 7 wherein the first pulley includes a bearing with a rotatable inner race.

10. The folder as recited in claim 7 wherein the first tape width being perpendicular to the travel direction of the first tape.

11. The folder as recited in claim 8 wherein the first tape width being perpendicular to the travel direction of the first tape.

12. A tape transport system for printed products comprising:

a tape having a tape width, a pulley, a lever arm supporting the pulley, the lever arm having a first side and a second side, the pulley having a first section disposed on the first side of the lever arm and a second section disposed on the second side of the lever arm, the first and second sections supporting the tape so that the lever arm is within the tape width, and a second pulley on the lever arm, the second pulley having a second pulley first section on the first side and a second pulley second section on the second side.

13. The tape transport system as recited in claim 12 wherein the tape contacts the pulley and the second pulley in a 180 degree fashion.

* * * * *